US006890612B2

(12) United States Patent
Goering

(10) Patent No.: US 6,890,612 B2
(45) **Date of Patent: *May 10, 2005**

(54) ARTICLE AND METHOD OF MAKING

(75) Inventor: Jonathan Goering, York, ME (US)

(73) Assignee: Albany International Techniweave, Inc., Rochester, NH (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/899,330

(22) Filed: Jul. 5, 2001

(65) Prior Publication Data

US 2002/0081416 A1 Jun. 27, 2002

Related U.S. Application Data

(63) Continuation-in-part of application No. 09/796,942, filed on Mar. 1, 2001, which is a continuation-in-part of application No. 09/749,318, filed on Dec. 27, 2000, now Pat. No. 6,733,862.

(51) Int. Cl.[7] ..... B32B 3/04

(52) U.S. Cl. ..... 428/57; 428/8; 428/12; 428/81; 428/119; 428/121; 428/124; 428/129; 428/130; 428/192; 428/194; 493/51; 493/68; 493/69; 493/79; 493/162; 493/243; 493/251; 493/405

(58) Field of Search ..... 493/51, 68, 69, 493/79, 162, 243, 251, 405; 428/8, 12, 57, 81, 119, 121, 124, 129, 130, 192, 194, 178, 542.8; 425/121, 129, 131, 134, 136; 270/39.01; 206/784, 822, 494

(56) References Cited

U.S. PATENT DOCUMENTS

| | | | | | |
|---|---|---|---|---|---|
| 623,548 | A | * | 4/1899 | Hurdei | 428/121 |
| 3,623,924 | A | * | 11/1971 | De Winter | 156/267 |
| 3,994,421 | A | | 11/1976 | Hansen | |
| 4,292,966 | A | | 10/1981 | Mono et al. | |
| 4,725,485 | A | | 2/1988 | Hirokawa | |
| 4,906,506 | A | | 3/1990 | Nishimura et al. | |
| 4,922,968 | A | | 5/1990 | Bottger et al. | |
| 5,064,705 | A | | 11/1991 | Donovan, Sr. | |
| 5,100,713 | A | | 3/1992 | Homma et al. | |
| 5,316,819 | A | * | 5/1994 | Nemoto et al. | 428/102 |
| 5,505,194 | A | | 4/1996 | Adjei et al. | |
| 5,521,000 | A | | 5/1996 | Owens | |
| 5,817,409 | A | | 10/1998 | Stephan et al. | |
| 5,904,139 | A | | 5/1999 | Hauser | |
| 6,412,325 | B1 | | 7/2002 | Croswell | 72/324 |

FOREIGN PATENT DOCUMENTS

| | | |
|---|---|---|
| DE | 88 02 711.2 | 3/1988 |
| DE | 197 16 637 A1 | 4/1997 |
| DE | 198 05 456 A1 | 11/1998 |
| EP | 0 243 105 A1 | 10/1987 |
| EP | 0 426 158 A2 | 5/1991 |
| EP | 0 683 035 A1 | 11/1995 |
| FR | 2 561 106 | 3/1984 |
| GB | 854222 | 11/1960 |
| GB | 1 205 275 | 3/1968 |

OTHER PUBLICATIONS

International Search Report prepared by EPO and issued for PCT/US01/49520; mailed Jul. 9, 2002.
Internatioanl Search Report prepared by EPO and issued for PCT/US02/06215; mailed Jul. 11, 2002.

* cited by examiner

*Primary Examiner*—Elizabeth M. Cole
(74) *Attorney, Agent, or Firm*—Frommer Lawrence & Haug LLP; Ronald R. Santucci

(57) ABSTRACT

A sheet of material which is made two dimensional which includes portions that are removed that allows the sheet to be folded to create a three dimensional structure without the need for cutting and darting.

12 Claims, 3 Drawing Sheets

Construction Of 2D Sheet Material

Figure 1 - Construction Of 2D Sheet Material

Figure 2 - Sequence Of Folds To Form 3D Structure

ARTICLE AND METHOD OF MAKING

CROSS-REFERENCE TO RELATED APPLICATIONS

This application is a continuation-in-part of U.S. Ser. No. 09/796,942 filed Mar. 1, 2001, now allowed, entitled "Reinforced Article and Method of Making" which is a continuation-in-part of U.S. Ser. No. 09/749,318, filed Dec. 27, 2000, now U.S. Pat. No. 6,733,862, entitled "Reinforced Article and Method of Making" the disclosures of which are incorporated herein by reference

FIELD OF THE INVENTION

The present invention relates to a substrate which is formed into a three dimensional article.

BACKGROUND OF THE INVENTION

Fiber reinforced composite structures enjoy the benefit of being lightweight while providing mechanical advantages such as strength. However, in many applications, molded plastic, wood or metal structures are preferred due to the cost involved, since they are relatively easy to fabricate. Often times however, articles, such as package or storing crates, are prone to damage due to the rough handling involved or are limited in their stacking ability due to weight and strength considerations. While fiber reinforced composite structures would be more desirable, the expense involved in making a somewhat complex three dimensional (3D) structure is a consideration.

This is because composite structures start off typically with a woven flat substrate of fibers. The substrate then has to be shaped into the form of the article which is then coated with a resin and thermoformed or cured in the desired shape. This may be readily done for relatively flat or smooth surfaces. However, for angled surfaces such as at the junction of the sides, corners and bottoms of a box or crate, cutting or darting is required. This is somewhat labor intensive and adds to the cost of manufacture. For things typically considered to be inexpensive, for example a packaging crate, the added expense may outweigh the benefits of it being reinforced.

While woven 3D structures may be woven by specialized machines, the expense involved is considerable and rarely is it desirable to have a weaving machine dedicated to creating a simple structure.

In addition to creating 3-D structures made out of fiber reinforcement, it is also desirable to make 3-D structures out of 2-D sheet material which may be sheet metal, plastic, cloth, paper, cardboard, etc.

Accordingly, while three dimensional articles, reinforced or otherwise, are desirable in many applications, there exists a need to reduce the cost involved in the method of their manufacture. By doing so it may also allow for their relative mass production and wide spread application.

SUMMARY OF THE INVENTION

It is therefore a principal object of the invention to minimize or eliminate the need to cut and dart sheets of material for 3D structures.

It is a further object as part of this to simplify the manufacture of such structures and reduce the labor requirement.

These and other objects and advantages will be apparent from the present invention. The present invention is directed toward providing a specially designed sheet of material for a 3D structure. It starts off as a 2D structure that is then formed into a 3D structure, particularly one having deep draws. To provide for this, the sheet of material is formed in a manner that has areas which would gather and distort the edges of the 3D structure which is formed by folding the sheet. The edges of the remaining portions of the sheet which formed the boundary of the removed area can be left as is or can be seamed using methods such as welding, thermal bonding or adhesive bonding.

BRIEF DESCRIPTION OF THE DRAWINGS

Thus by the present invention its objects and advantages will be realized the description of which should be taken and in conjunction with the drawings wherein.

DETAILED DESCRIPTION OF THE PREFERRED EMBODIMENT

Figure 1:
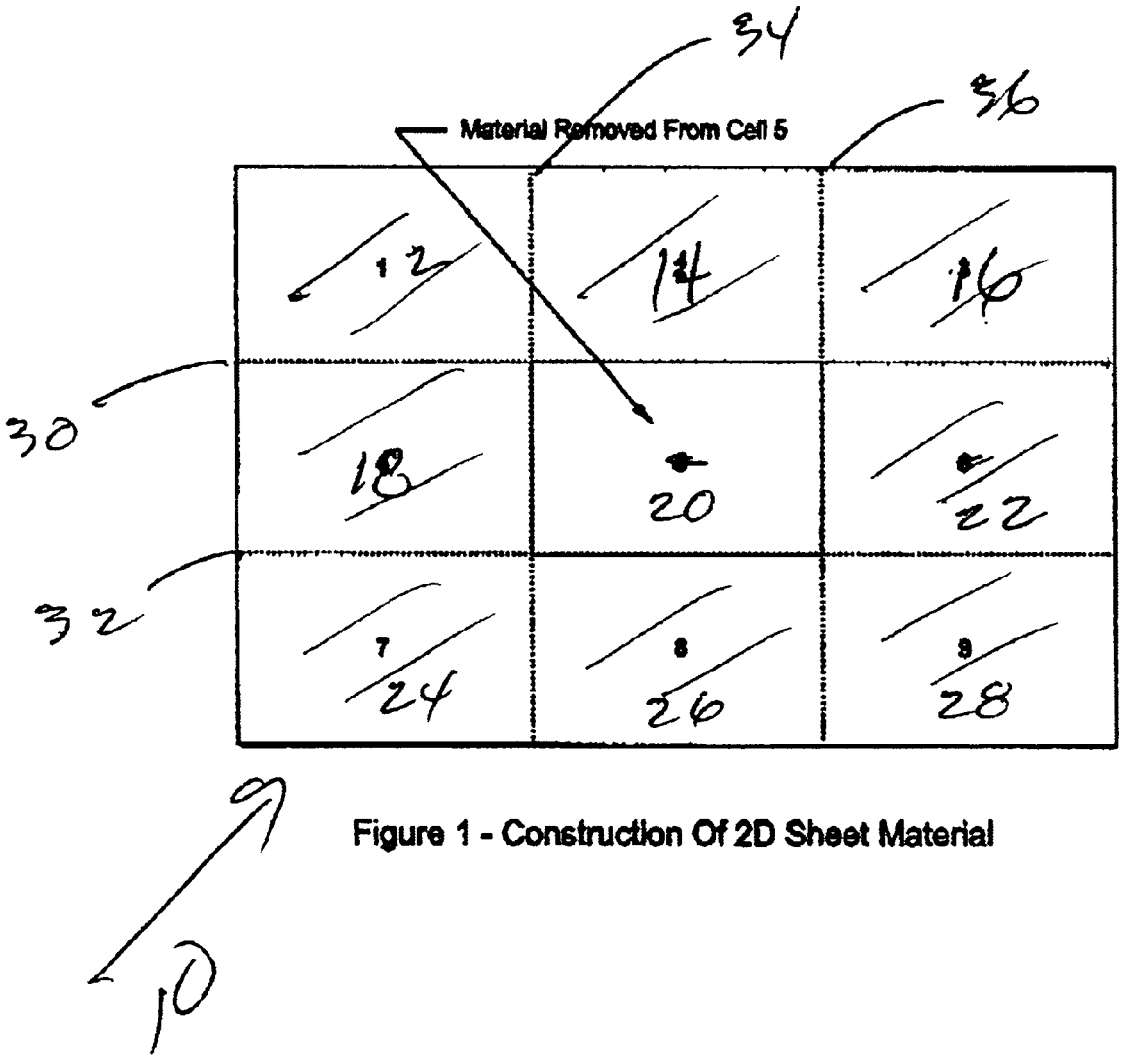
FIG. 1 illustrates the construction of a flat 2D sheet of material incorporating the teachings of the present invention.

Turning now more particularly to the drawings, like parts will be similarly numbered. In FIG. 1, there is shown a flat 2D sheet of material 10 which illustrates the present invention. The sheet 10 may be made of sheet metal, plastic, cloth, paper, cardboard or any other material suitable for the purpose.

For purposes of this illustration in FIG. 1, the sheet 10 has been divided into regions or areas 12 through 28 divided along fold lines 30–36. The sheet material has either been removed or the sheet formed without it leaving an open space.

Once the sheet 10 is constructed, it can then be formed into the desired shape.

Figure 2:
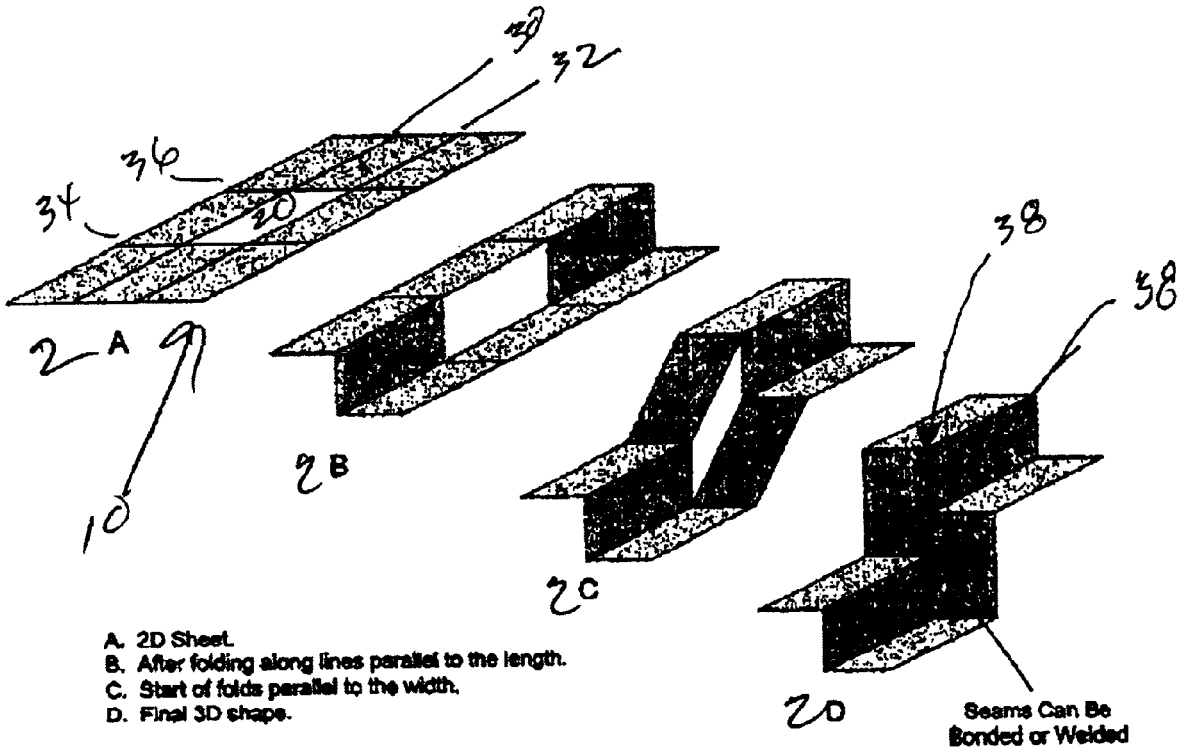
FIGS. 2A–2D illustrates the sequence of folding the sheet to produce deep draws.

Turning now to FIGS. 2A–2D, shown in FIG. 2A is the flat 2D sheet 10. The sheet 10 is then folded along fold lines 30 and 32. The sheet 10 is then folded along fold lines 34 and 36 which are perpendicular to the fold lines 30 and 32 as shown in FIG. 2C. In this process since there is no material in region 20 the adjacent areas are allowed to be folded into an abutting relationship as shown in FIG. 2D. The edge or corner 38 so formed can be left as is or can be seamed by way of, for example, welding, thermal bonding, adhesive bonding or other means suitable for the purpose. Folding can be done automatically or by other means suitable for this purpose.

The foregoing advantageously avoids the need for cutting or darting, thereby reducing the amount of labor required and the ultimate cost of the article. The present invention allows for the increased automation of the fabrication and therefore broadens the applications for which such structures may be used.

Figure 3:
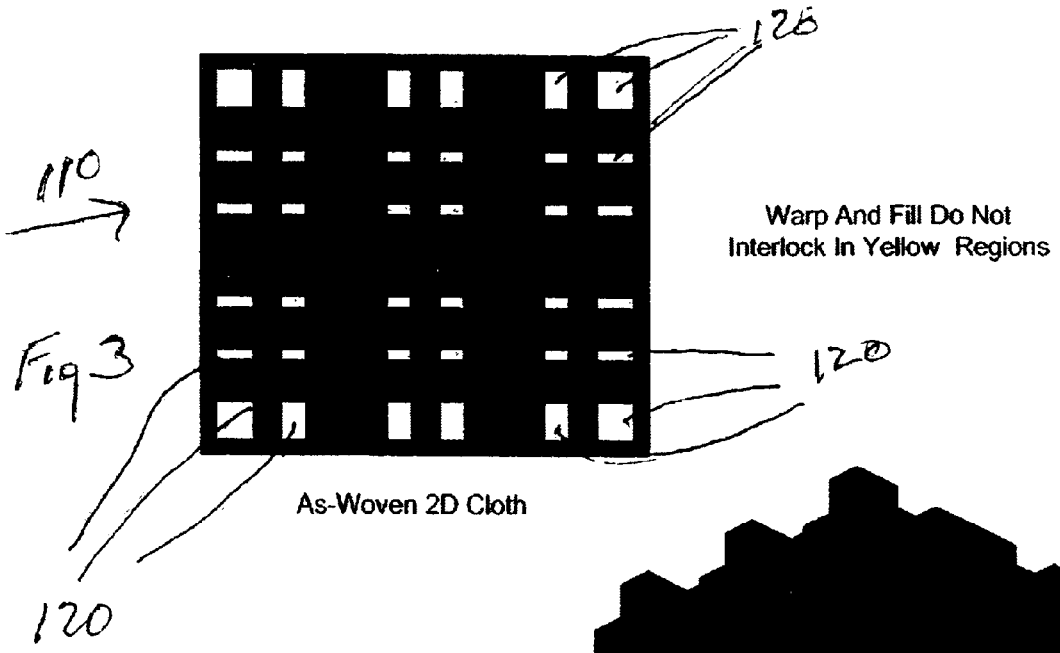
FIG. 3 illustrates a 2D sheet having multiple areas removed to create a complex structure upon folding or drawing down.
Figure 4:
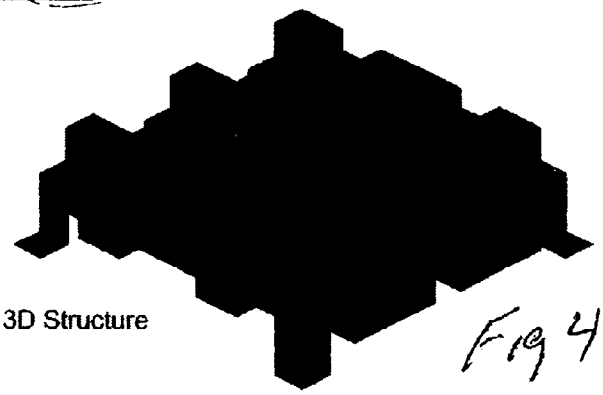
FIG. 4 is a perspective view of a 3D structure formed from the sheet shown in FIG. 3.

Turning now briefly to FIG. 3 there is shown a flat 2D sheet 110. Sheet 110 illustrates a plurality of regions 120 wherein the sheet material has been removed. With such a sheet 110, it may be folded and shaped into a complex structure 130 as shown in FIG. 4. Of course other shapes can be created by varying the size and location of the regions where the material is removed.

Thus by the present invention its objects and advantages are realized and although preferred embodiments have been disclosed and described in detail herein, its scope should not be limited thereby rather its scope should be determined by that of the appended claims.

What is claimed is:

1. A flat sheet of material for forming a structure having a three dimensional shape, said sheet comprising:

material forming the sheet in a first portion of the sheet;

a second portion of the sheet where material comprising the sheet is removed, said second portion being surrounded by said first portion and having a first edge and a second edge which are perpendicular to each other; and wherein the sheet when folded creates a first fold line in a first direction parallel to said first edge, and when folded in a second direction parallel to said second edge creates a second fold line so as to cause said first edge and said second edge to come into alignment with each other so as to be parallel with each other, and wherein after folding the first portion which comes into an abutting relationship is seamed.

2. The sheet according to claim 1, which includes a plurality of first portions and second portions.

3. The sheet according to claim 2, wherein the second portions are surrounded by first portions.

4. The sheet according to claim 1, wherein said seam is by welding, thermal bonding or adhesive bonding.

5. The sheet according to claim 1, wherein the sheet is capable of being folded at a junction formed between the first portion and the second portion.

6. A method of forming a structure having a three dimensional shape using a sheet, said method comprising the steps of:

forming the sheet to create a first portion of the sheet with sheet material;

removing a portion of the sheet to create a second portion of the sheet without sheet material which has a first edge and a second edge which are perpendicular to each other; and folding said sheet along a first fold line parallel to said first edge and then folding the sheet in a second direction parallel to said second edge to create a second fold line so as to cause said first edge and said second edge to come into alignment with each other so as to be parallel with each other;

wherein said second portion is surrounded by said first portion.

7. The method according to claim 6, which includes the step of forming the sheet with a plurality of first portions and second portions.

8. The method in accordance with claim 6, wherein the folding takes place at a junction formed between the first portion and the second portion.

9. The method in accordance with claim 6, which includes the step of seaming an abutment formed by the folding.

10. The method according to claim 9, wherein seaming is done by welding, thermal bonding or adhesive bonding.

11. A structure having a three dimensional shape made from a flat sheet comprising material having a portion where the material is removed, said portion being surrounded by the material and having a first edge and a second edge which are perpendicular to each other, wherein the material is folded to create a first fold line in a first direction parallel to said first edge and is folded in a second direction parallel to said second edge to create a second fold line so as to cause said first edge and said second edge to come into alignment with each other so as to be parallel with each other.

12. The structure according to claim 11, which includes a plurality of portions.

* * * * *